US006893285B1

(12) United States Patent
Chiang

(10) Patent No.: US 6,893,285 B1
(45) Date of Patent: May 17, 2005

(54) GUIDE CONNECTOR

(75) Inventor: Thomas Chiang, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 7 days.

(21) Appl. No.: 10/885,201

(22) Filed: Jul. 6, 2004

(30) Foreign Application Priority Data

May 7, 2004 (TW) ..... 93207150 U

(51) Int. Cl.[7] ..... H01R 13/631

(52) U.S. Cl. ..... 439/378; 439/65

(58) Field of Search ..... 439/374, 378, 439/65, 142–144, 247

(56) References Cited

U.S. PATENT DOCUMENTS

| | | | | |
|---|---|---|---|---|
| 5,092,774 A * | 3/1992 | Milan | 439/66 |
| 5,222,907 A * | 6/1993 | Katabuchi et al. | 439/377 |
| 5,391,091 A * | 2/1995 | Nations | 439/378 |
| 6,409,525 B1 * | 6/2002 | Hoelscher et al. | 439/140 |
| 6,821,135 B1 * | 11/2004 | Martin | 439/144 |

* cited by examiner

*Primary Examiner*—Hien Vu
(74) *Attorney, Agent, or Firm*—Welsh & Katz, Ltd.

(57) ABSTRACT

A guide connector aims to connect two circuit boards to transmit signals between the two. The guide connector has a second guiding dock latching on one circuit board so that free ends of metal transmission lines of the guide connector may be securely inserted into insert holes of the circuit board. A first guiding dock is provided to connect other circuit board to enable other free ends of the metal transmission lines to be aligned with and inserted into insert holes of the other circuit board.

5 Claims, 2 Drawing Sheets

GUIDE CONNECTOR

FIELD OF THE INVENTION

The present invention relates to a guide connector for connecting two circuit boards to transmit signals.

BACKGROUND OF THE INVENTION

Refer to FIG. 1 for a conventional guide connector that connects two circuit boards to meet multiple functional requirements of a programmable logic controller. The programmable logic controller usually has a plurality of circuit boards 400 to execute different operational requirements. A connector 500 is provided to connect two circuit boards 400 to transmit signals there between.

The conventional connector 500 consists of metal transmission lines 501 and two anchor docks 502. The metal transmission lines 501 have two free ends, inserting respectively into insert holes 402, formed on the two circuit boards 400 for transmitting signals there between. The two anchor docks 502 couple and hold the metal transmission lines 501 to maintain the relative coupling positions.

The structure set forth above has drawbacks, notably:

First, the diameters of the metal transmission line 501 and insert holes 402 on the circuit boards 400 are very small. During assembly on production lines in large number, it tends to occur that the metal transmission lines 501 do not completely align with the insert holes 402 because of equipment deviations and tolerances. This results in damage of the metal transmission lines 501 or circuit boards 400 and causes drop of production yield.

Second, connection of the connector 500 and the circuit boards 400 solely relies on coupling of the metal transmission lines 501 and the insert holes 402. This is not a reliable structure. The connector 500 is easily damaged because of external shaking. As a result, signal transmission in the programmable logic controller will be affected.

Third, the conventional connector 500 is a fixed apparatus. If the distance between two circuit boards 400 is shrunk, the original connector 500 becomes useless, and a new one has to be fabricated. This results in additional costs and waste of resources.

SUMMARY OF THE INVENTION

Therefore, the object of the present invention is to provide a guide connector, to connect two circuit boards reliably and conveniently.

To achieve the foregoing object, the guide connector according to the invention aims to connect a first circuit board and a second circuit board for transmitting signals between the two, and the distance between the two circuit boards is shortened as desired, without affecting its functions.

The first circuit board has a plurality of insert holes and two guiding bores on two sides of the insert holes.

The second circuit board also has a plurality of insert holes and two latch bores on two sides of the insert holes.

The guide connector includes a first anchor dock, a second anchor dock, a first guiding dock and a second guiding dock. Metal transmission lines have two ends inserting respectively to the insert holes of the two circuit boards, to transmit signals there between. The first anchor dock and the second anchor dock are coupled with the metal transmission lines to fix the relative positions thereof. The first guiding dock is coupled on the metal transmission lines in a sliding manner between the first anchor dock and the free ends of the metal transmission lines. It has two ends, holding respectively a guiding post, which corresponds to each of the two guiding bores of the first circuit board, to facilitate alignment of the metal transmission lines with the insert holes on the first circuit board. The first guiding dock slides freely to make adjustment according to the distance between the first and the second circuit boards. The second guiding dock is coupled with the metal transmission lines in a sliding manner and located between the first and the second anchor docks, to couple latch members located on two ends into the latch bores, thereby, to facilitate steady insertion of the metal transmission lines into the insert holes of the second circuit board.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
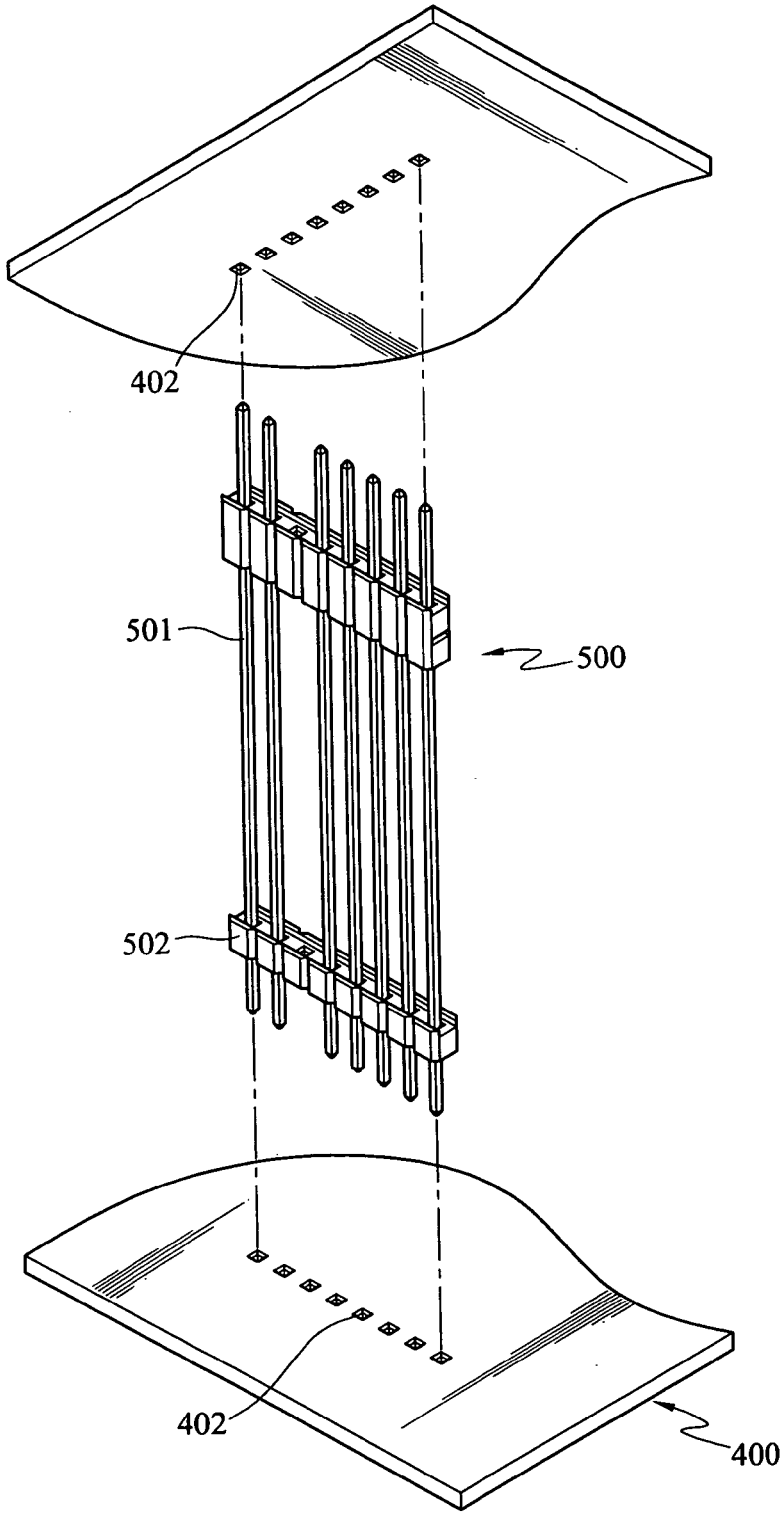
FIG. 1(PRIOR ART)
FIG. 1 is a perspective view of a conventional connector and two circuit boards.
Figure 2:
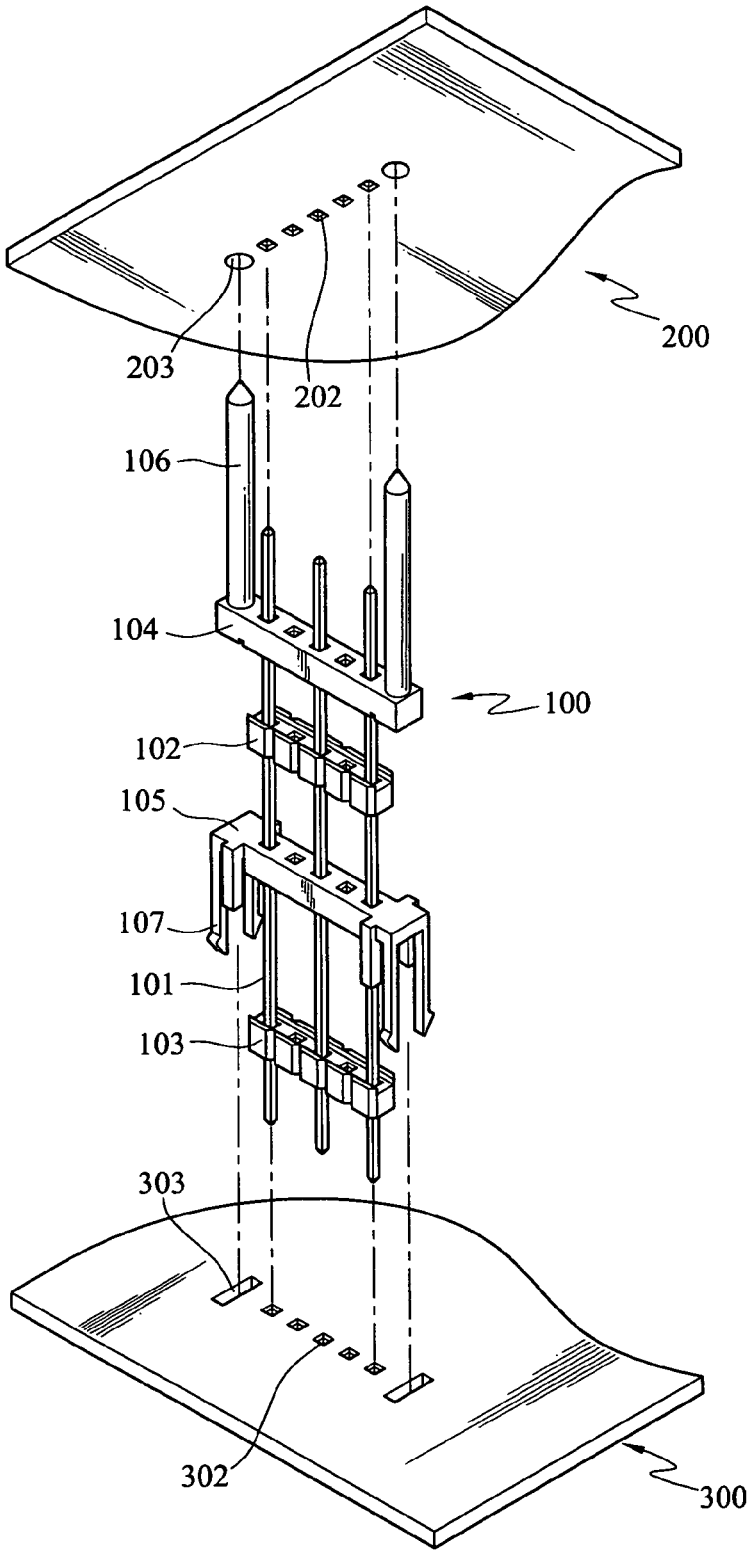
FIG. 2 is a perspective view of a connector and two circuit boards of the invention.

Refer to FIG. 2 for the guide connector and two circuit boards of the invention. The guide connector 100 is adopted for use on various types of electronic devices (such as programmable logic controllers) to connect two circuit boards 200 and 300 to transmit signals between the two.

The programmable logic controller in an embodiment of the invention includes a first circuit board 200 and a second circuit board 300 that have respectively circuits located thereon to execute related commands. The first and second circuit boards 200 and 300 have respectively a plurality of insert holes 202 and 302, to connect to the guide connector 100, to transmit signals.

The first circuit board 200 further has two guiding bores 203 located on two outer sides of the insert holes 202.

The second circuit board 300 further has two latch bores 303 located on two outer sides of the insert holes 302.

The guide connector 100 includes a plurality of metal transmission lines 101, a first anchor dock 102, a second anchor dock 103, a first guiding dock 104 and a second guiding dock 105. The first guiding dock 104 has two ends holding a guiding post 106, and the second guiding dock 105 has two ends holding a latch member 107.

The metal transmission lines 101 have two ends inserting to the insert holes 202 and 302 of the two circuit boards 200 and 300, to transmit signals there between. The length of the metal transmission lines 101 is adjustable through the first guiding dock 104 according to the distance between the first and the second circuit boards 200 and 300. If the distance between the two circuit boards 200 and 300 is shortened, adjust the first guiding dock 104 to move the first circuit board 200 close to the second circuit board 300, then cut off the free ends of the metal transmission lines 101 that extend outside the second circuit board 300, to fit the distance between the two circuit boards 200 and 300.

The metal transmission lines 101 are inserted into the first and second anchor docks 102 and 103 through two ends and clamped there between, to be maintained on desired locations.

The first guiding dock 104 is coupled with the metal transmission lines 101 and located between the first anchor dock 102 and the free ends of the metal transmission lines 101, and slides on the metal transmission lines 101. Namely, the first guiding dock 104 is moved freely on the metal transmission lines 101 at a desired location. The guiding post 106 on each side of the first guiding dock 104 corresponds to one of the guiding bores 203 of the first circuit board 200.

The second guiding dock 105 is coupled with the metal transmission lines 101 and slides between the first anchor dock 102 and the second anchor dock 103. The latch members 107 on two ends thereof correspond to the latch bores 303 on the second circuit board 300.

For assembly of the guide connector 100, first determine the relative distance of the metal transmission lines 101; couple the first anchor dock 102 with the metal transmission lines 101 to fix the positions of the metal transmission lines 101; couple the first guiding dock 104 on the metal transmission lines 101 on one side of the first anchor dock 102 to be sliding on the metal transmission lines 101; then couple the second guiding dock 105 on the metal transmission lines 101 on another side of the first anchor dock 102 also to be sliding on the metal transmission lines 101. Finally, couple the second anchor dock 103 on the metal transmission lines 101, to confine the second guiding dock 105 between the first and the second anchor docks 102 and 103.

When in use, first insert the free ends of the metal transmission lines 101 into the insert holes 302 of the second circuit board 300. Insert the latch members 107 on two ends of the second guiding dock 105 into the latch bores 303 of the second circuit board 300 to form a secured latch relationship, so that the guide connector 100 is held steadily on the second circuit board 300.

Next, move the first guiding dock 104 away from the first anchor dock 102 for a desired distance, to extend the guiding posts 106 beyond the metal transmission lines 101. Insert the guiding posts 106 of the first guiding dock 104 into the guiding bores 203 of the first circuit board 200, and slide the first guiding dock 104 to align the metal transmission lines 101 with the insert holes 202 of the first circuit board 200. Insert the metal transmission lines 101 into the insert holes 202, to complete connection of the guide connector 100 with the first circuit board 200.

In addition, the guide connector of the invention is also adapted, to connect two circuit boards of any electronic device other than the programmable logic controllers. The programmable logic controller previously discussed serves only for illustrative purpose and is not the limitation of the invention.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What is claimed is:

1. A guide connector for connecting a first circuit board and a second circuit board for transmitting signals there between with the circuit boards having respectively a plurality of insert holes and the first circuit board having two guiding bores on two sides of the insert holes thereof and the second circuit board having two latch bores on two sides of the insert holes thereof, comprising:

a plurality of metal transmission lines having two ends insertable into the insert holes of the first circuit board and the second circuit board to transmit the signals between the two circuit boards;

a first anchor dock and a second anchor dock coupling respectively with the metal transmission lines to fix the relative positions of the metal transmission lines;

a first guiding dock coupled on the metal transmission lines having respectively a guiding post on two ends thereof corresponding to and insertable into the guiding bores of the first circuit board to facilitate alignment and insertion of the metal transmission lines with the insert holes of the first circuit board and being adjustable to shorten the distance between the first circuit board and the second circuit board to extend free ends of the metal transmission lines outside the second circuit board to be cut off to suit the distance of the two circuit boards; and a second guiding dock coupled on the metal transmission lines having respectively a latch member on two ends thereof corresponding to and latchable into the latch bores of the second circuit board to form a latched relationship to securely insert the metal transmission lines into the insert holes of the second circuit board.

2. The guide connector of claim 1, wherein the first guiding dock is slidably coupled on the metal transmission lines.

3. The guide connector of claim 1, wherein the first guiding dock is located between the first anchor dock and the free ends of the metal transmission lines.

4. The guide connector of claim 1, wherein the second guiding dock is slidably coupled on the metal transmission lines.

5. The guide connector of claim 1, wherein the second guiding dock is located between the first anchor dock and the second anchor dock.

* * * * *